US005907873A

United States Patent [19]

Brandolf

[11] Patent Number: 5,907,873

[45] Date of Patent: Jun. 1, 1999

[54] TOILET LID/SEAT CLOSING RETURN MECHANISM

[76] Inventor: Henry E. Brandolf, 190 Winfield Ridge Rd., Winston-Salem, N.C. 27103

[21] Appl. No.: 09/053,176

[22] Filed: Apr. 1, 1998

[51] Int. Cl.[6] ..... A47K 13/10

[52] U.S. Cl. ..... 4/246.1

[58] Field of Search ..... 4/246.1–246.5, 4/250, 248

[56] References Cited

U.S. PATENT DOCUMENTS

| | | | |
|---|---|---|---|
| 1,529,656 | 3/1925 | Kornhauser . | |
| 1,616,509 | 2/1927 | Rehn . | |
| 1,907,826 | 5/1933 | Kapp . | |
| 3,056,142 | 10/1962 | Chin | 4/250 |
| 3,579,664 | 5/1971 | Johnson | 4/250 |
| 4,839,928 | 6/1989 | Probasco | 4/246.1 |
| 4,951,325 | 8/1990 | Tack | 4/246.1 |
| 4,995,120 | 2/1991 | Tager . | |
| 5,060,318 | 10/1991 | Jaskiewicz . | |
| 5,101,518 | 4/1992 | Phillips . | |
| 5,319,810 | 6/1994 | Metzger . | |
| 5,488,744 | 2/1996 | Paananen . | |
| 5,592,700 | 1/1997 | Genesse . | |
| 5,689,838 | 11/1997 | MacKenzie | 4/246.1 |

*Primary Examiner*—Charles R. Eloshway
*Attorney, Agent, or Firm*—Cahn & Samuels, LLP

[57] ABSTRACT

A toilet seat return assembly including a deflector element for placement on the front of the toilet tank and a rotatable and pivotable arm attached to the flush handle adapted to rotate upon rotation of the flush handle and cam against the tank mounted deflector to pivot away from the tank front wall, contacting and pivoting the toilet seat to the closed position.

10 Claims, 2 Drawing Sheets

FIG. 4
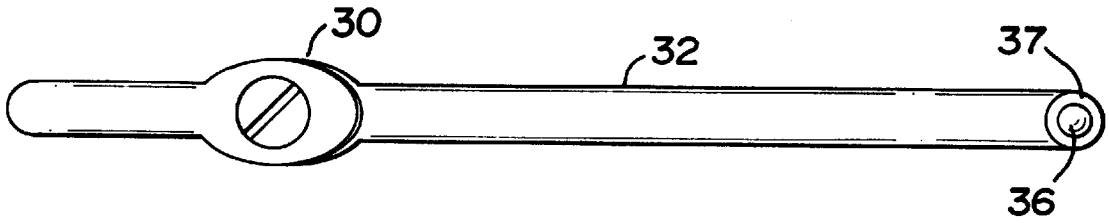
FIG. 5
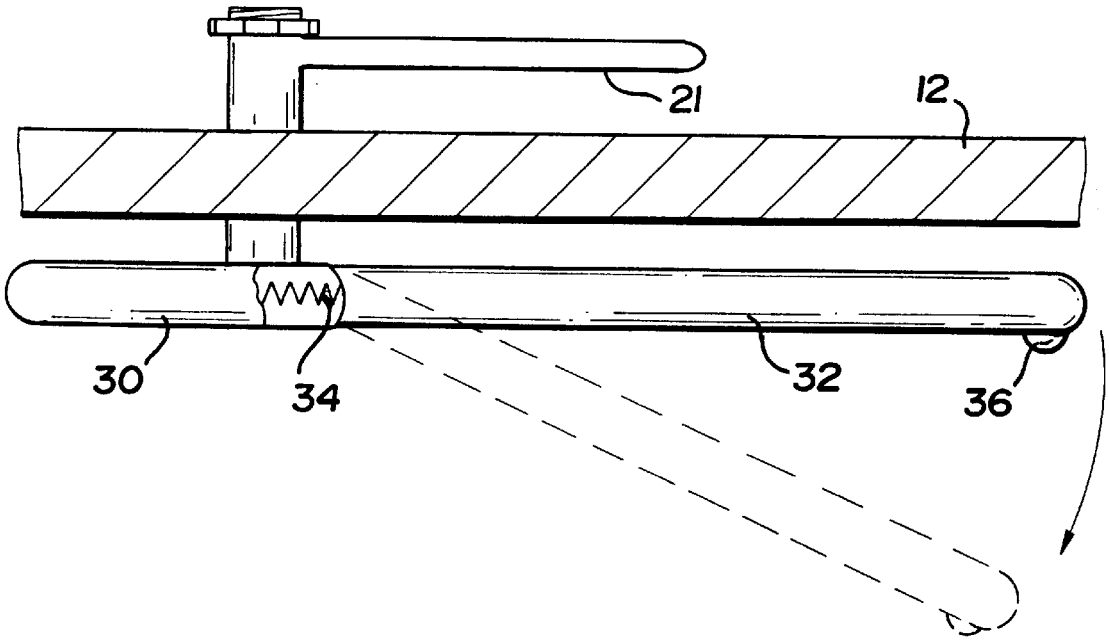
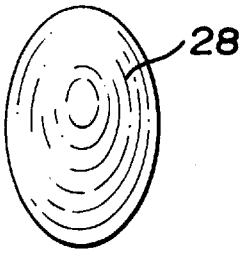
FIG. 6
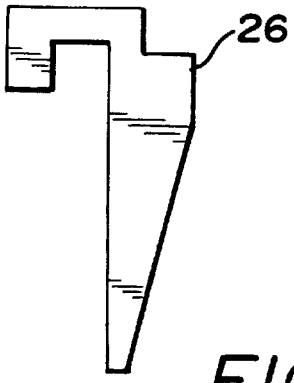
FIG. 7

TOILET LID/SEAT CLOSING RETURN MECHANISM

TECHNICAL FIELD

The present invention is directed to improvements in toilet seat closing and return mechanisms. More particularly, the invention provides a simple, flush handle actuated, lever and deflector assembly relying only on the cooperation of a lever and inclined plane and gravitational force to pivot a toilet lid cover and seat to the closed position. The inventive mounting assembly herein defines a structural combination that avoids complexity, is simple to install and is usable with any toilet having a pivoting seat.

BACKGROUND OF THE INVENTION

Over the years many different ideas and systems have emerged for the single purpose of returning a toilet seat from a vertical/open position to a horizontal/closed position. Indeed the underlying problem, use of a toilet by males who inadvertently or negligently fail to return the seat to the closed/lowered position, is so common as to be the subject of many comic routines. The problem becomes serious, however, when it involves persons with chronic or acute disabilities or physical limitations.

The patent literature describes many structures and assemblies addressing the problem of lid/seat return systems that pivot a toilet seat from the open/vertical position to the closed/lowered position. These mechanisms range from timed liquid flow counterweight arrangements (U.S. Pat. No. 5,101,518) and mechanical pivot mounted spring return actuators (U.S. Pat. No. 1,529,656) to hydraulic systems (U.S. Pat. No. 5,488,744) and electronically actuated geared motors (U.S. Pat. No. 4,995,120). At least one recent patent has recognized use of the flush handle to actuate toilet lid/seat closing. That mechanism includes a camming arm that is installed to either the tank or seat (U.S. Pat. No. 5,592,700). However, the mechanical embodiments (in contrast to the disclosed electronic switch version) require either careful positional alignment of the articulated extension arm which is connected to a projection from the side of the toilet tank or a multi-arm structure in order to achieve the required degree of pivoting to move the lid past its center of gravity.

Notwithstanding the usefulness of the above-described closure mechanisms and systems, a need still exists for a versatile, essentially universal, mechanically actuated toilet seat closure system where the system is easily adjusted and is capable of convertible installation in a wide variety of structural environments typically encountered in bathrooms. Furthermore, a need remains for a simple general utility toilet seat closing assembly that not only is readily adapted for mounting on any of the variety of tank configurations, but also which provides uniformity in appearance and strength for residential and commercial use.

SUMMARY OF THE INVENTION

It is therefore an object of the present invention to provide a mechanical toilet seat closing/return mechanism that overcomes the above noted shortcomings and other problems of the prior art.

It is another object of the invention to provide an improved toilet seat closing assembly for universal application and use on a flush handle style flush toilet and for heavy or light duty use.

It is another object of the invention to provide an improved, simple, mechanical flush/gravity actuated assembly capable of providing standardized appearance and adequate strength for use with all types of flush type toilet tanks.

Still other objects of this invention are satisfied by a method of securing a toilet lid/seat return mechanism to the front of a toilet tank.

A further object of this invention is to provide a toilet seat closing assembly structure providing, at once, simplicity, standardized size, conformational uniformity, adequate strength, structural integrity, and retrofitablity.

Still another object of the invention is to provide a general utility toilet seat closing assembly that may be conveniently, efficiently, and inexpensively manufactured, assembled, and mounted with minimal labor and time.

These and other objects are satisfied by a toilet lid/seat return assembly for a toilet with a base, a toilet seat hingedly mounted to the base, and a toilet flush tank affixed to said base, said flush tank including a partially rotatable flush handle, front wall, a rimmed open top, and a lid, said assembly comprising:

a deflector body for securing to the flush tank on the front wall proximate said flush handle; and, an arm with first and second ends, said first end being attached to the flush handle in a manner where upon rotation of the flush handle to flush said toilet causes said arm to rotate between a first neutral position and a second toilet seat engaging and closing position, said arm having a length corresponding at least to the distance between said flush handle and said deflector body where, as the arm rotates between the first and second positions, it cams against the deflector body to cause the second end of said arm to deflect away from the front wall of said tank a distance sufficient to contact the toilet seat or lid and pivot it to the closed position.

Further objects of the present invention are satisfied by a method of returning to the closed position, a toilet bowl lid pivotally mounted on a toilet bowl and resting against the toilet tank which incorporates a flush handle, comprising the steps of:

attaching a deflector body to the toilet tank;

attaching a resilient, flexible extension arm to the toilet tank flush handle;

flushing the toilet by rotating the handle thereby imparting rotational force to the arm which cams against the deflector body, angularly displacing the arm from the toilet tank and thereby pivoting the toilet bowl lid to the closed position.

Given the following enabling description of the drawings, the inventive assembly should become evident to a person of ordinary skill in the art.

BRIEF DESCRIPTION OF THE DRAWINGS

FIG. 4 is front view of a spring bias, hinged flush handle and extension arm assembly according to the embodiment of the invention illustrated in FIG. 3.

FIG. 5 is partial, cutaway assembly top view of the flush handle and extension arm assembly according to the embodiment of the invention illustrated in FIG. 3.

FIG. 6 is front view of an ovoid, tank mounted, arm deflector according to the embodiment of the invention illustrated in FIG. 2.

FIG. 7 is side view of a wedge, tank lip mounted, deflector according to the embodiment of the invention illustrated in FIG. 1.

DETAILED DESCRIPTION OF THE ILLUSTRATED EMBODIMENTS

Figure 1:
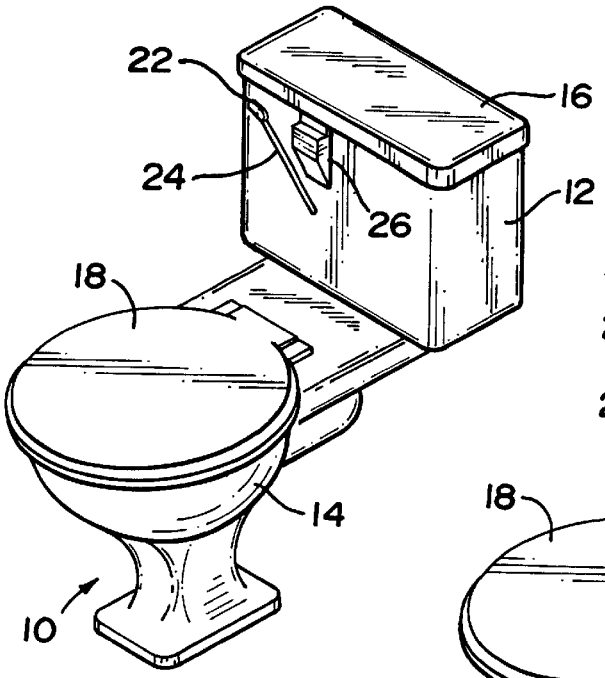
FIG. 1 is a perspective view of a first embodiment of a toilet lid/seat closing mechanism according to the invention.

FIG. 1 illustrates a first embodiment of the toilet seat return assembly of the present invention. The toilet 10 comprises a water flush tank 12 mounted on a bowl containing base 14. The tank 12 is covered by a top lid 16 and the bowl is covered by the bowl lid/cover 18. The bowl lid 18 and toilet seat 20 are hingedly mounted to the upper, back surface of the base near the tank and base junction. A flush handle 22 is rotatably mounted on the front of the tank, typically near the upper left corner. Conventionally, by depressing/rotating the handle, the stopper chain arm 21 in the tank 12, rotates and lifts the tank stopper located in the tank bottom to release the flushing water into the bowl.

Figure 2:
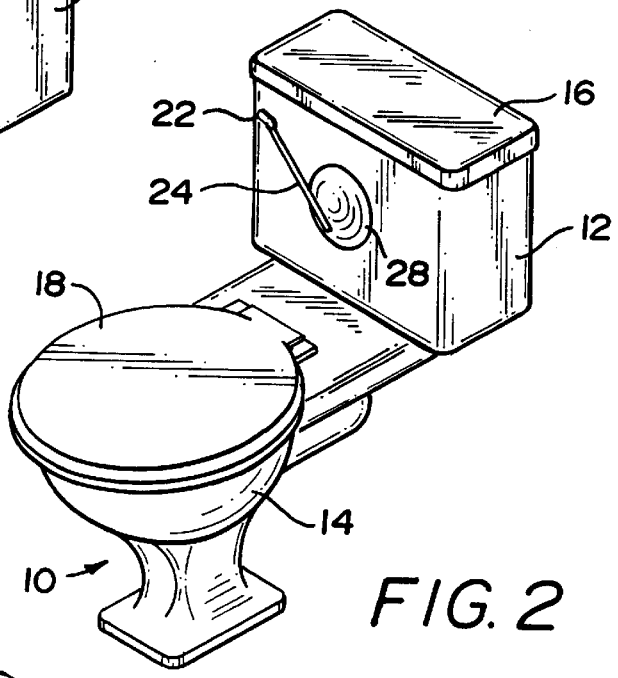
FIG. 2 is perspective view of a second embodiment of a toilet lid/seat closing mechanism according to the invention.

In this invention, the handle is connected to an extension arm 24 that extends across the front wall of the tank 12. The extension arm 24 in the embodiment illustrated in FIGS. 1 and 2 is formed of a resilient and flexible material. It can be composed of plastic, rubber, metal, composites, or ceramics, which may or may not be reinforced with spring metal and the like. The material is acceptable so long as it retains its strength, resiliency, and integrity for many thousands of flushes so that it flexes upon contact with the deflector 26 with sufficient strength to push lid 18 from an open to a closed position while possessing the capacity to return to its original configuration upon return of the handle 22 to the neutral position. The capability to pivot the lid to the open position where it will rest is important for commodious use of the toilet. Thus, the deflector must not project so far from the front wall of the tank 12 to cause closing of the lid during toilet use. In other words, the deflector 26 cannot project so far from the front wall that the undesirable effect is to prevent the lid from being maintained in the open position without holding it. Furthermore, during sitting use, the deflector surface in contact with the lid must be of an adequate surface area to avoid stress fracture formation, cracking, or damage to the upper surface of the toilet bowl lid.

It is the cooperation between the wedge deflector 26 and the extension arm 24 upon which the functional aspects of this invention are based. As the flush handle 22 is rotated to release the tank stopper and actuate flushing of the toilet, the extension arm 24 arcs upwardly to meet the inclined surface of the wedge member 26. The greater the rotation caused by rotation of the handle 22, the further the arm 24 moves up the inclined surface of the wedge 26 and the greater the deflection of the arm 24 relative to the front wall of the tank 12. In this particular illustrated embodiment, the wedge deflector is secured to the front wall of the tank 12 using a hook over the lip of the tank (See FIG. 7). As will become evident in the descriptions of the various embodiments, the deflector of any appropriate configuration, may be attached by adhesive or any appropriate mechanical fastening means.

FIG. 2 represents an identical flush handle 22/extension arm 24 arrangement but illustrates a variation of the deflector 28 configuration (See also FIG. 6). In this embodiment, the deflector 28 is in the form of an ovoid/ellipsoid structure that includes an apex having a height sufficient to mimic the degree of deflection caused by the wedge deflector 26. During flushing, the arm 24 is deflected by camming against the deflector surface to push the lid 18 to the closed position. In this case, the ovoid deflector 28 is best attached to the tank using an appropriate adhesive. The deflector 28 provides a unique aesthetic opportunity in toilet design. Because the deflector may be constructed to have a large surface area, decorative/design elements such as colors, monograms, artwork, etc. can be included. The inclusion of aesthetic elements, in the context of the present invention, actually takes on increased significance. Because the invention contemplates the lid/seat being returned to the closed position, the front wall of the tank will generally be visible. Therefore, the inclusion of some decorative feature thereon may be desirable.

Figure 3:
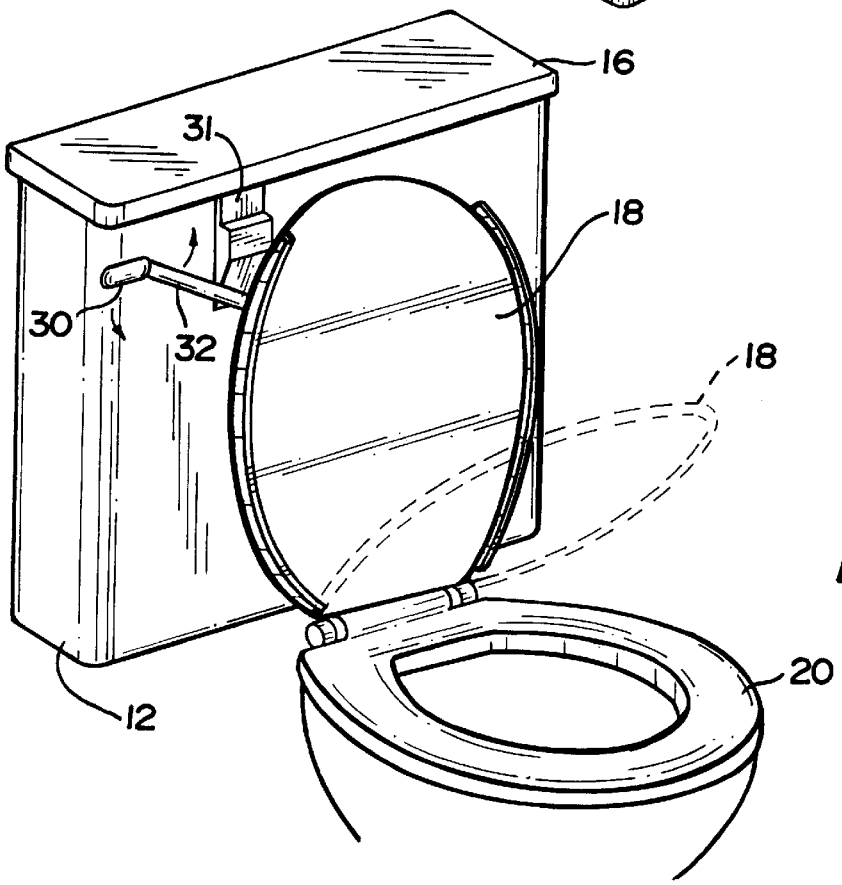
FIG. 3 is perspective view of a third embodiment of a toilet closing mechanism according to the invention.

FIGS. 3–5 represent a further embodiment of the invention which relies on a pivotable/spring bias extension arm 32 mounted on the handle 30. In this case, the deflector 31 is a wedge deflector mounted to the front of the tank 12 under the lid 16. The handle 30/arm 32 assembly is mounted on the flush handle shaft which is connected to the stopper chain arm 21. The arm 32 is mounted to the handle 30 with a hinge pin (not illustrated) and includes a spring 34 to bias the arm in the plane parallel to the tank front wall. (This structure is not unlike the linkage found on automotive windshield wipers.) The lid-contacting end of the arm features a friction reducing roller bearing 36 mounted in a grommet 37. The roller bearing projects forwardly from the arm so that it constitutes the contact line of the arm with the raised lid. Although illustrated as a roller bearing, it should be readily apparent that any conventional friction reducing structure or coating can be used.

The ghost lines included in FIGS. 3 and 5 indicate the operation of the invention. As handle 30 is pushed down, the arm 32 rotates counterclockwise. The back surface of the arm 32 contacts the inclined surface of the wedge deflector 31 which urges the arm away from the front of the tank 12. The roller bearing 36 contacts the back of the lid and pushes it from the vertical resting position and away from the front wall of the tank 12. The rotation of the extension arm moves it to cam against the inclined surface and progressively deflects the arm 32. At a particular point, the pivoting lid crosses its center of gravity where gravitational forces move the lid to the closed position. Due to the gravitationally induced movement, the lid would have a tendency to slam onto the toilet bowl. To prevent load noise or damage from such forceful closure, the seat, lid or bowl may be equipped with rubber pads or some other appropriate damping material.

As noted, there are several variations contemplated by the invention. For example, the assembly can be installed as an add-on, as an integrated replacement structure or as original equipment. The deflector can be attached using adhesives, mechanical attachment or even integrated during toilet manufacturing where the deflector is formed as part of to the toilet tank front wall. As indicated in connection with FIG. 1, the less permanent arrangement is to rely on the "overhang" mode which relies on a bracket affixed to the wedge deflector to hang over the lip of the flush tank. Because the interaction between the wedge body and the arm does not in any way interfere with normal flush handle operation, both methods for complementary affixation can be employed with equal efficacy.

It should be apparent to the skilled artisan, that any appropriate composition may be used to establish the various above-described structures so long as such composition provides sufficient rigidity and strength to retain structural integrity. The design and color variations are essentially unlimited so long as arm/deflector assembly provides a structure with adequate strength to maintain the integrity during repeated use.

Given the foregoing, variations and modifications to the invention should now be apparent to a person having ordinary skill in the art. These variations and modifications are intended to fall within the scope and spirit of the invention as defined by the following claims.

I claim:

1. A toilet lid/seat return assembly for a toilet with a base, a toilet seat hingedly mounted to the base, and a toilet flush tank affixed to said base, said flush tank including a partially rotatable flush handle, front wall, a rimmed open top, and a lid, said assembly comprising:

a deflector body for securing to the flush tank on the front wall proximate said flush handle; and, an arm with first and second ends, said first end adapted for being attached to the flush handle in a manner where upon rotation of the flush handle to flush said toilet causes said arm to rotate between a first neutral position and a second toilet seat engaging and closing position, said arm having a length corresponding at least to the distance between said flush handle and said deflector body where, as the arm rotates between the first and second positions, it cams against the deflector body to cause the second end of said arm to deflect away from the front wall of said tank a distance sufficient to contact the toilet seat or lid and pivot it to the closed position.

2. The toilet lid/seat return assembly according to claim 1 where said deflector body is in the form of a wedge providing an inclined deflector plane where the wedge defines a first front planar surface adapted for projecting from the front wall at an acute angle, a second front planar plateau surface, a back wall, side walls, and a top hook member.

3. The toilet lid/seat return assembly according to claim 2 where the arm includes a first retaining segment and a second elongated element where the first retaining segment is adapted for being connected to the flush handle and where the first retaining segment and second elongated element are hingedly connected, the second elongated segment being biased toward the tank front wall.

4. The toilet lid/seat return assembly according to claim 3 where the second elongated element is resiliently flexible and bendable away from the tank front wall.

5. The toilet lid/seat return assembly according to claim 1 where the second end incorporates a friction reducing element to facilitate movement of the arm against the lid or seat.

6. The toilet lid/seat return assembly according to claim 5 where the friction reducing element is a roller bearing.

7. The toilet lid/seat return assembly of claim 1 further comprising a mounting bracket on the deflector body for securing the deflector body over the rimmed open top and against the front wall of the flush tank.

8. The lid/seat return assembly of claim 1 where the deflector body includes an adhesive for securing it to the flush tank.

9. The method of using the toilet lid/seat return mechanism of claim 1 including the steps of installing the deflector body to front wall of the tank and the arm to the flush handle and rotating the flush handle.

10. A method of returning to the closed position, a toilet bowl lid pivotally mounted on a toilet bowl and resting against the toilet tank which incorporates a flush handle, comprising the steps of:

attaching a deflector body to the toilet tank;

attaching a first end of a resilient, flexible extension arm to the toilet tank flush handle;

flushing the toilet by rotating the handle thereby imparting rotational force to the arm which cams against the deflector body, angularly displacing the second end of the arm away from the toilet tank to thereby contact the toilet bowl lid and cause it to pivot to the closed position.

* * * * *